US006250828B1

(12) United States Patent
Liu

(10) Patent No.: US 6,250,828 B1
(45) Date of Patent: Jun. 26, 2001

(54) OFFSET PEN

(75) Inventor: Bao-Shen Liu, Banchiau (TW)

(73) Assignee: Yoro Pen Corp., Lujou (TW)

( * ) Notice: Subject to any disclaimer, the term of this patent is extended or adjusted under 35 U.S.C. 154(b) by 0 days.

(21) Appl. No.: 09/418,435

(22) Filed: Oct. 14, 1999

(51) Int. Cl.[7] ..... A46B 5/02
(52) U.S. Cl. ..... 401/6; 401/195
(58) Field of Search ..... 401/6, 214, 216, 401/240, 230, 251, 195, 183, 184, 185

(56) References Cited

U.S. PATENT DOCUMENTS

| | | | | |
|---|---|---|---|---|
| D. 311,211 | * | 10/1990 | Oot | D19/43 |
| 655,731 | * | 8/1900 | Pierce | 401/230 |
| 849,513 | * | 4/1907 | Sturm | 401/240 |
| 1,747,167 | * | 2/1930 | Hill | 15/443 |
| 2,713,848 | * | 7/1955 | Miessner | 401/183 |
| 3,352,621 | * | 11/1967 | Fehling et al. | 401/109 |
| 3,900,268 | * | 8/1975 | Bok | 401/230 |
| 5,405,208 | * | 4/1995 | Hsieh | 401/195 |
| 5,523,928 | * | 6/1996 | Kim | 362/118 |
| 5,527,124 | * | 6/1996 | Kolaric | 401/6 |
| 5,893,674 | * | 4/1999 | Dowst | 401/209 |

* cited by examiner

*Primary Examiner*—Gregory L. Huson
*Assistant Examiner*—Huyen Le
(74) *Attorney, Agent, or Firm*—Fay, Sharpe, Fagan, Minnich & McKee, LLP

(57) ABSTRACT

An offset pen including a holding portion, a writing portion, and an intermediate portion connected between the holding portion and the writing portion to make the holding portion and the writing portion positioned in different axes is disclosed. The writing portion is separable from the holding portion, for example by dividing the intermediate portion into two engageable parts or by detaching the writing portion from the intermediate portion, in order to facilitate the production of the crooked offset pen and/or the installation of a writing material.

27 Claims, 20 Drawing Sheets

OFFSET PEN

FIELD OF THE INVENTION

The present invention is related to an offset pen, and more particularly to an offset pen having a structure advantageous for easy making and convenient assembling.

BACKGROUND OF THE INVENTION

So far, conventional writing tools such as fountain pen, pencil, ball point pen, coloring pencil and writing brush on the market are all linear in shape. That is, a writing head and a holding stick of a writing tool are substantially coaxial. Owing to the limit of people's palm structure, the writing tool generally tilts rearward the wrist while being used so that the vision line of the user will be obstructed by the writing tip of the writing tool. As such, there are several defects in writing or drawing with the conventional writing tool. First of all, a user cannot clearly see the space behind the writing tool along the vision line, so it is difficult for the user to write straight or draw in position. Especially for kids, they are likely to change their sitting posture, e.g. lie their heads upon the desks, while writing in an attempt to bypass the blockage of the vision line by the writing tool, and it is harmful to kids' eyesight and bone.

In addition, people are used to holding the writing tool slantwise, so the linear shape of the writing tool results in the slant of the writing portion relative to the working surface, and as such, the user gets no right point to exercise the pressing point and has to exert more stress on the working surface while writing or drawing. The inevitable fatigue would ruin children's interests in writing. Furthermore, the slant of the writing portion relative to the working surface makes the drawing operations with an assistant tool such as a ruler unable to achieve the best effect, since the writing tip will not be in close contact with the side surface of the ruler.

Moreover, under special writing conditions, the writing operation may suffer from the interruption of ink provided that an ink-type pen such as a ball point pen, is used. For example, if a user would like to write on a substantially vertical surface at a position higher than his head, a pen will be held slant so that the writing tip becomes higher than the ink reservoir. It is apparent that such an orientation of the pen is likely to result in the interruption of the ink owing to the adverse flow of the ink from the writing tip due to gravity. Even if the writing operation is performed on a substantially vertical surface at a relatively low position, for example lower than the height of the user's chest, the wrist of the user's writing hand has to significantly and uncomfortably bend toward the user's body in order to assure of good contact between the writing tip and the writing surface for smooth writing.

The present inventor found that the above problems can be solved by providing a nonlinear writing tool called an "offset pen" hereinafter. An offset pen includes an intermediate portion between a holding portion, i.e. the pen stick, and a writing portion, i.e. the writing head, to make the holding portion and the writing portion positioned in different axes. For example, FIGS. 1~3 schematically show how is an offset pen used to solve the above problems.

Please refer to FIG. 1A in which an offset pen including a holding portion A, an intermediate portion B and a writing portion C is shown. Owing to the presence of the crooked intermediate portion B, the axis of the writing portion C and that of the holding portion A will intersect at a certain angle to create a space therebetween. In addition, the angle between the writing portion C and the working surface can be made to be approximately 90 degrees owing to the offset of the writing portion. As such, the vision line of the user will not be obstructed by the writing tool as by the front portion P1 of a conventional pen. Accordingly, the writing operation of the user will proceed relatively smoothly. Furthermore, the crooked intermediate portion B provides an additional structure suitable for user's index finger to rest and exert force thereon, as shown in FIG. 1B, so as to lessen the load of user's fingers. The effect is especially prominent for duplication with carbon paper.

Please refer now to FIG. 2 in which an offset pen is used together with a ruler R. By using an offset pen including a holding portion A, an intermediate portion B and a writing portion C as mentioned above, the writing portion C is approximately perpendicular to the working surface K so as to be in close contact with the side surface R2 of the ruler R. As such, the user will be able to draw a line precisely as desired without being influenced by his palm structure and the thickness of the ruler.

FIGS. 3A and 3B schematically show the situations of the offset pen for use to write on a vertical surface at a relatively high and a relatively low positions, respectively. Referring to FIG. 3A, the crooked intermediate portion B allows a section of the ink reservoir B1 to remain higher than the writing tip C1 so as to avoid the interruption of the ink. Referring to FIG. 3B, the pen-holding posture can be adjusted to be comfortable by simply turning the offset pen by 180 degrees using the holding portion of the pen as the turning axis.

Even though advantageous over conventional linear pens in many aspects, the offset pen encounters problems in manufacturing and assembling. It is complicated to produce a crooked and hollow pen structure. Furthermore, the ink refill or reservoir is difficult to be installed into the crooked pen structure, and also inconvenient to be replaced.

SUMMARY OF THE INVENTION

Therefore, an objective of the present invention is to provide an offset pen which is mounted therein a writing material to leave marks on a working surface and has a structure advantageous for easy making and convenient assembling.

Basically, an offset pen structure according to the present invention includes a holding portion to be supported by a user's writing hand, a writing portion to be mounted thereon a writing tip of the writing material, and an intermediate portion located between the holding portion and the writing portion to make the writing portion deflect from the axis of the holding portion. Characteristically, the writing portion is separable from the holding portion so as to facilitate the mounting of the writing material. For example, the intermediate portion includes two engageable parts, a first part of which is connected to the holding portion and a second part of which is connected to the writing portion. The first part constitutes an upper part of the intermediate portion, and the second part is partly inserted into the first part to constitute a lower part of the intermediate portion. Alternatively, the second part is integrally formed with the writing portion and completely inserted into the first part to form a lower surface of the intermediate portion. Thereby, the writing portion is allowed to be separated from the holding portion through the disengagement of the first and the second parts of the intermediate portion.

Alternatively, the writing portion is detachably mounted to the intermediate portion so that the writing portion is allowed to be separated from the holding portion through the disengagement of the intermediate portion and the writing portion.

Preferably, a hollow passage which extends from the writing portion through the intermediate portion to the holding portion is arranged within the offset pen for accommodating a writing material including the writing tip and an ink supply.

In a preferred embodiment, the offset pen is a retractable pen which allows the writing tip to selectively protrude from or to be retracted into the writing portion in response to a user's operation. In order to achieve this purpose, the offset pen includes a button and a spring. The button is mounted on a top end of the holding portion, and has a hollow tube to be engaged with the ink supply. When the button is pushed down to depress the writing material from a relatively high position to a relatively low position, the writing tip can be made to protrude from the writing portion to be used. On the other hand, when the button is pushed down again to release the writing tip from the relatively low position to the relatively high position, the writing tip can be retracted into the writing portion to be received. The spring is installed in the hollow passage around the writing material, and has a first end urging against a sustaining element arranged on the writing material and a second end urging against a wall of the hollow passage. When the button is pushed down, a compressive elastic force of the spring will be generated. When the button is pushed again, the compressive elastic force will be provided for the release of the button so as to retract the writing tip into the writing portion. The second end of the spring mentioned above is a resilient rod sustaining against a facing-up wall of the hollow passage in the intermediate portion.

According to the present invention, the holding portion can be detached from the intermediate portion to expose the hollow passage to air so that the ink supply can be installed therefrom. Alternatively, an end portion of the holding portion can be opened to expose the hollow passage to air so that the ink supply can be installed therefrom. On the other hand, the holding portion can be integrally formed with the intermediate portion, and the ink supply can be installed from the intermediate portion.

With regard to the ink supply, the holding portion can serve as the ink supply, i.e. ink is directly stored in the hollow passage in the holding portion. If the holding portion is flexible, ink can be transmitted to the writing tip by pressing the holding portion. The ink supply can be an elongated ink refill extending from the writing portion through the intermediate portion to the holding portion. Alternatively, the ink supply can includes an ink reservoir and an ink passage. The ink reservoir is installed in the hollow passage in the holding portion for providing therefrom ink. The ink passage is connected to the ink reservoir and the writing tip for transmitting ink from the ink reservoir to the writing tip, and has a shape and a size complying with a configuration of the hollow passage in the intermediate portion so as to extend through the intermediate portion.

Preferably, the ink reservoir is separable from the ink passage so as to allow the ink reservoir to be replaced.

The ink reservoir can be a hollow tube for storing therein ink, and the ink passage can be an hollow tube or an ink-soaking strip. Alternatively, the ink reservoir and the ink passage are both ink-soaking strips for adsorbing therein ink. It depends on the type of the writing tip which can be a felt tip, a nib tip or a brush tip.

Preferably, the ink supply is wrapped by an ink-proofing material to prevent ink from leakage. The ink-proofing material can be a form of a film or a tube, and may be soft or flexible.

According to another aspect of the present invention, the offset pen further includes an illuminating device. The illuminating device is mounted to a lower part of the intermediate portion, e.g. the second part, to lighten an area near the writing tip. Preferably, the writing tip is substantially located in an extension line of the holding portion so that light emitted from the illuminating device can be centered on the writing tip.

The illuminating device is preferably a point light source, e.g. a light bulb. A battery for supplying power for the illuminating device can be installed in the holding portion.

BRIEF DESCRIPTION OF THE DRAWING

The present invention may best be understood through the following description with reference to the accompanying drawings, in which.

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Embodiment 1

Figure 1A:
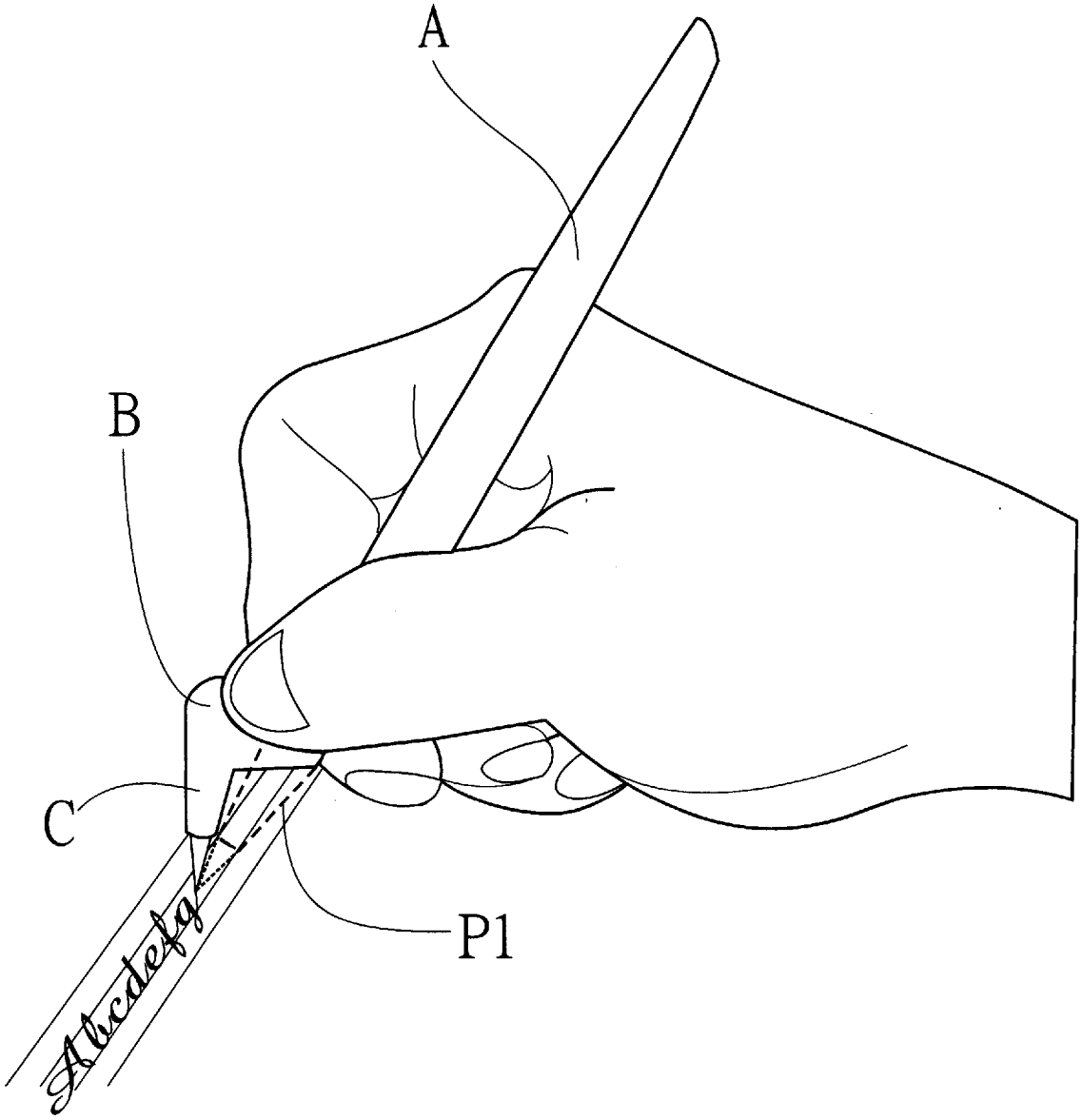
FIG. 1A is a schematic perspective diagram showing the use of an offset pen compared to the use of a linear pen.
Figure 1B:
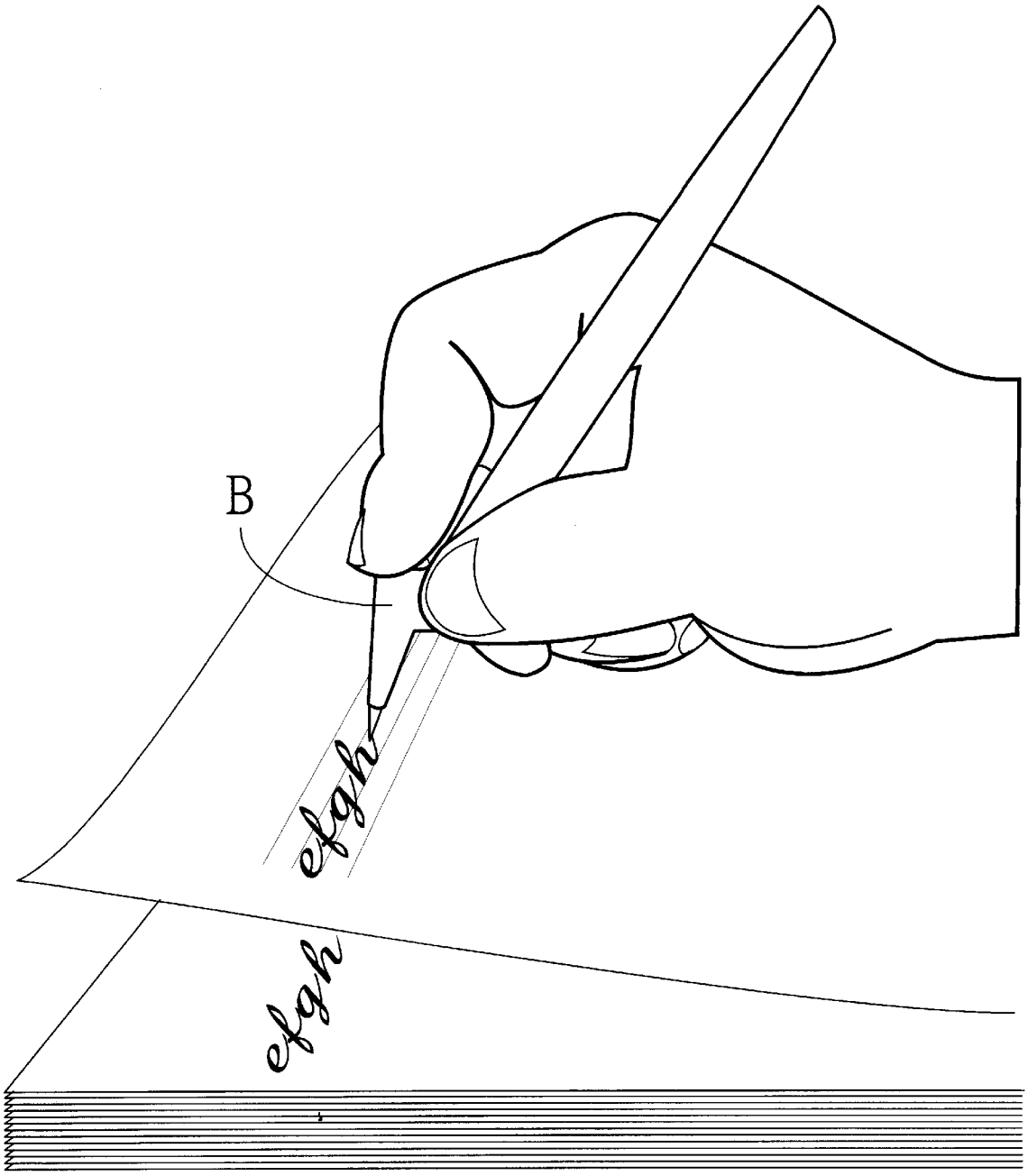
FIG. 1B is a schematic perspective diagram showing the use of an offset pen used for duplicate writing.
Figure 2:
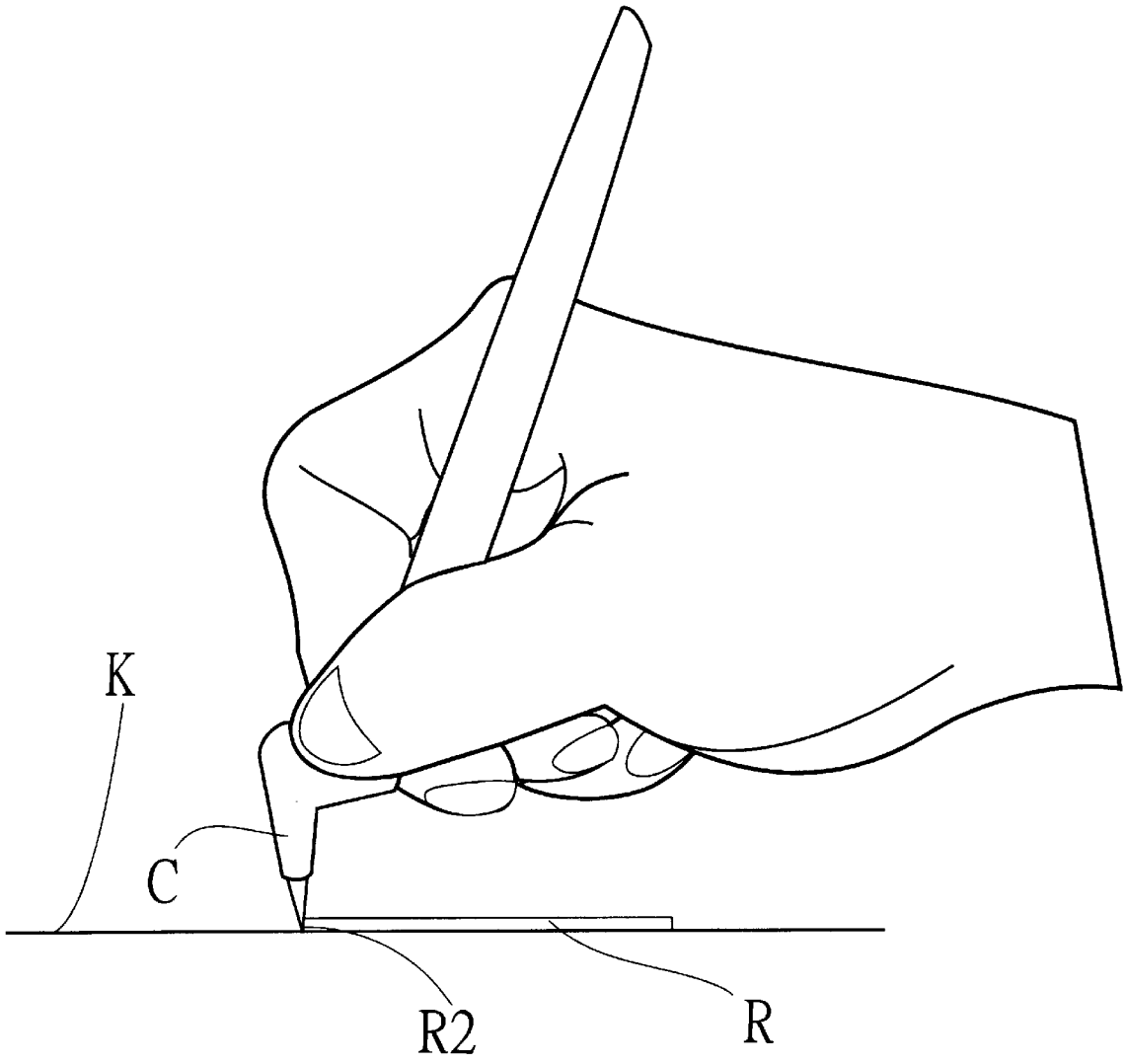
FIG. 2 is a schematic perspective diagram showing the use of an offset pen together with a ruler.
Figure 3A:
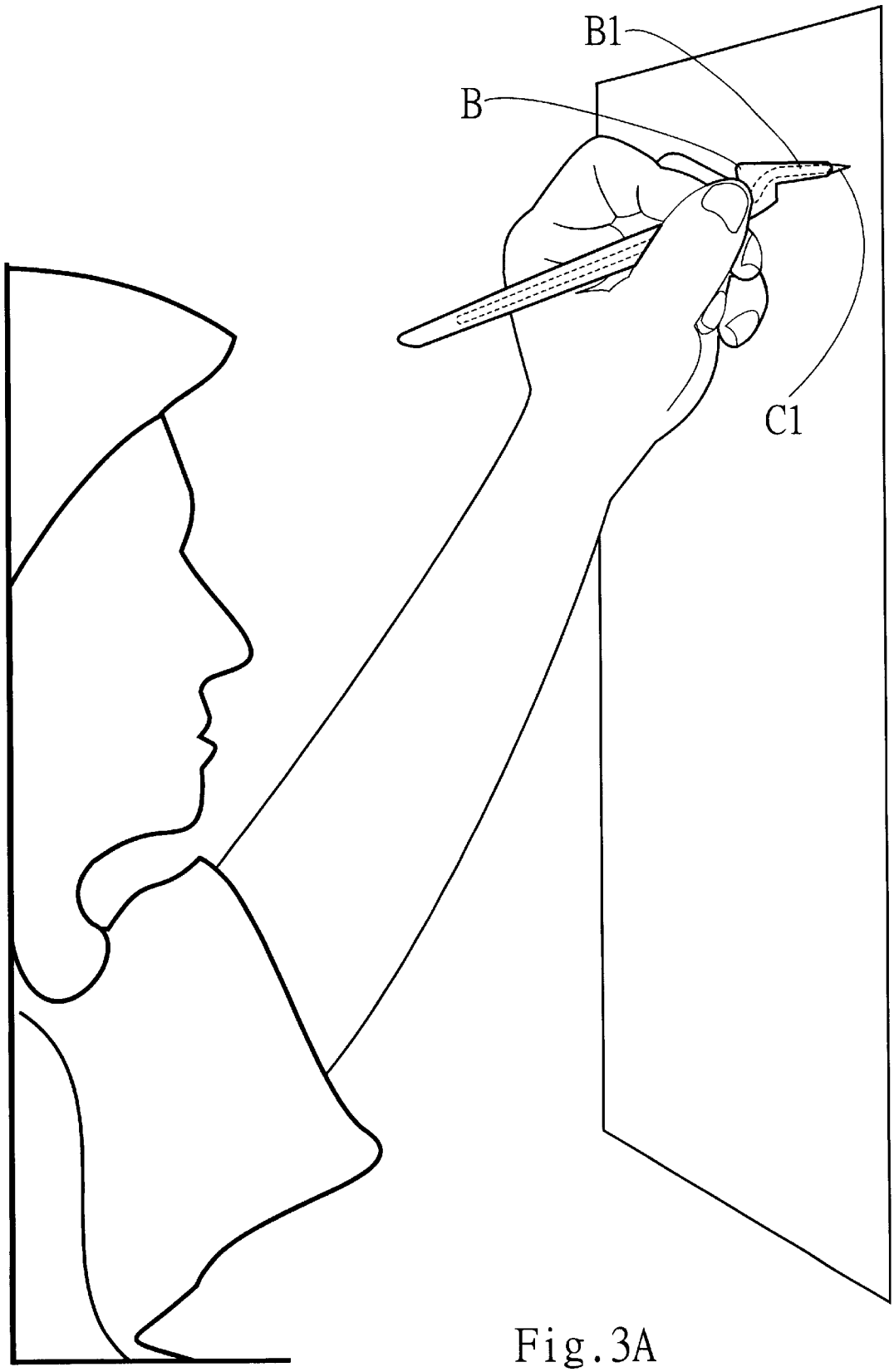
FIGS. 3A and 3B are schematic perspective diagrams showing the situations of the offset pen for use to write on a vertical surface at a relatively high and a relatively low positions, respectively.
Figure 3B:
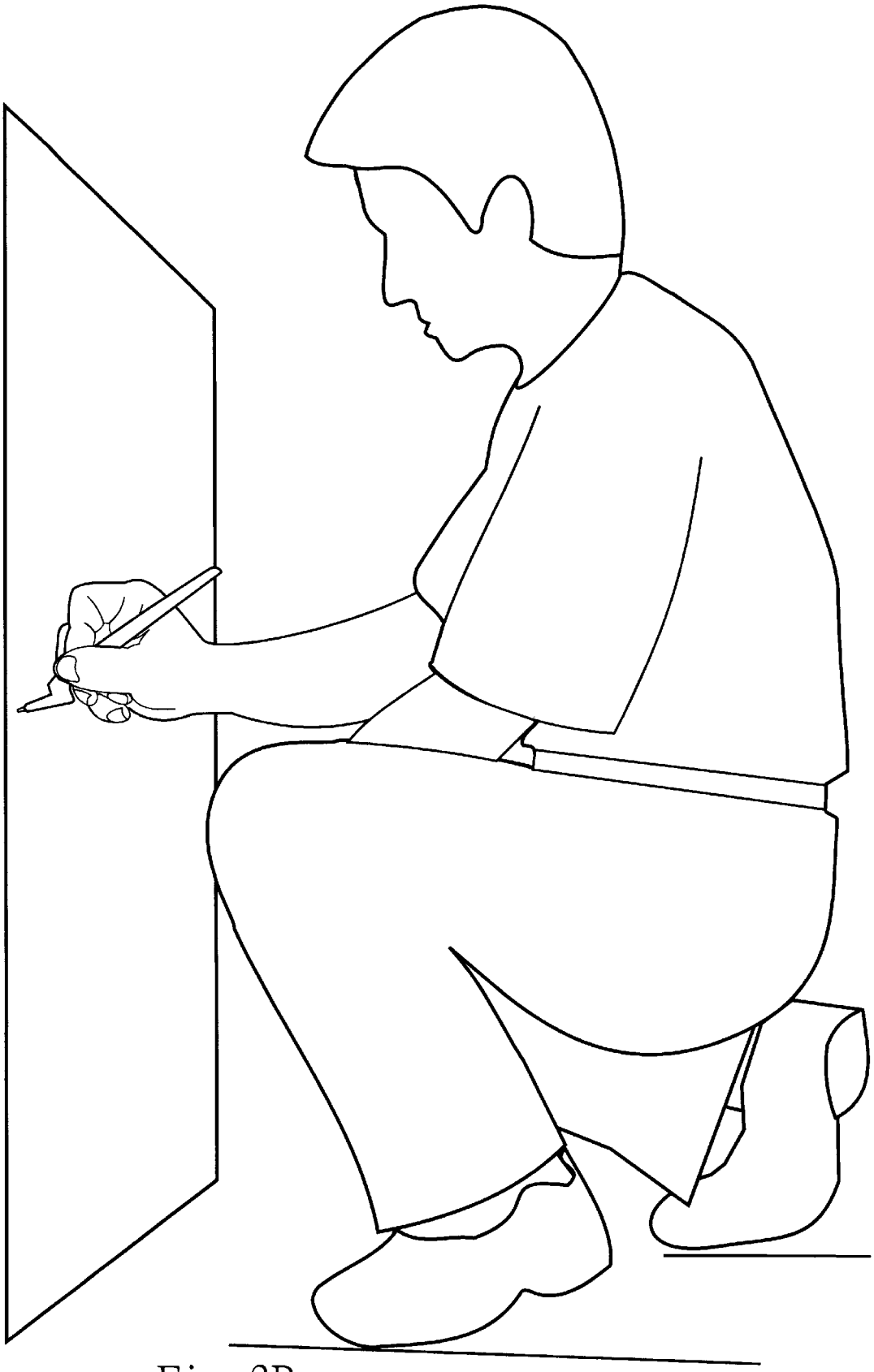
Figure 4A:
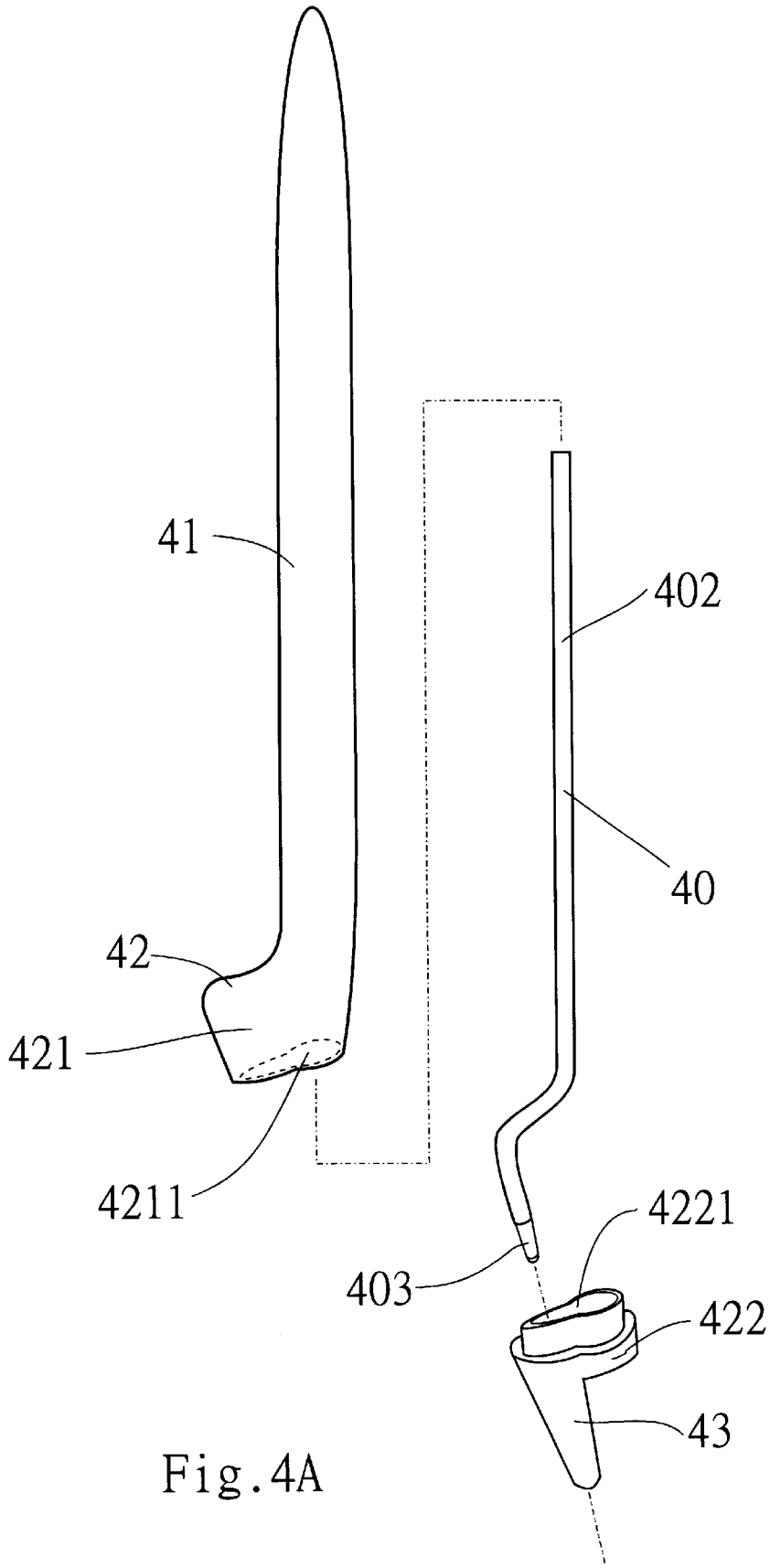
FIG. 4A is a resolving perspective diagram of a first preferred embodiment of an offset pen according to the present invention, which schematically shows the mounting of a writing material into the offset pen.
Figure 4B:
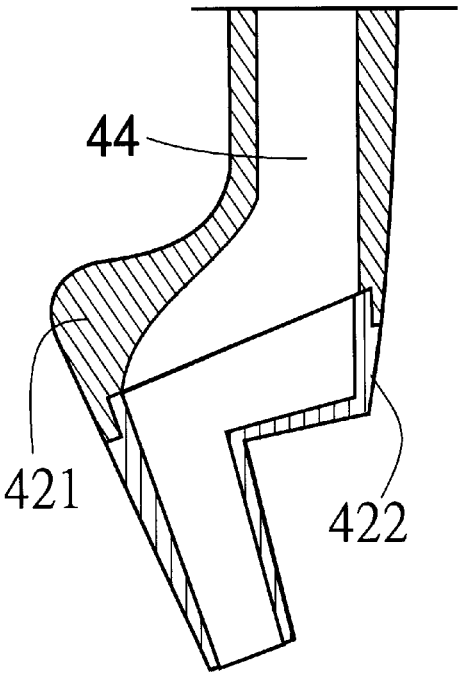
FIG. 4B is a partial cross-sectional view of the offset pen of FIG. 4A, which schematically shows the assembling of the offset pen.
Figure 4C:
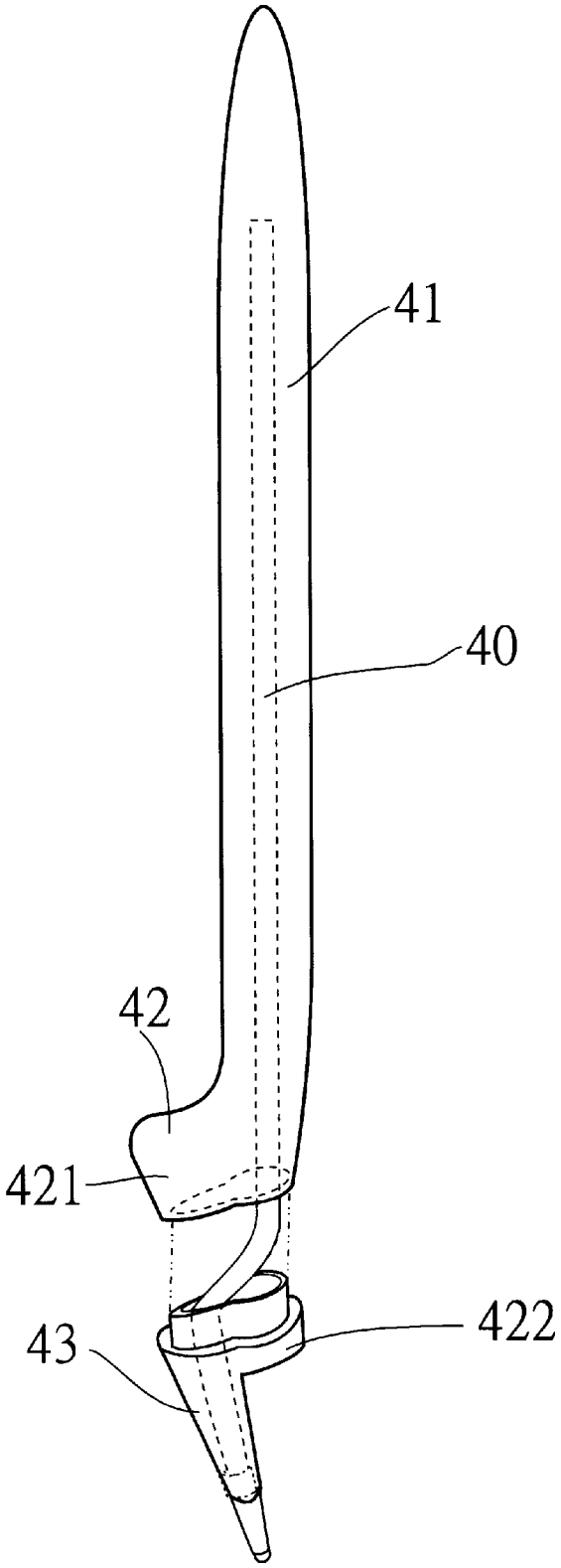
FIG. 4C is a perspective diagram of the offset pen of FIG. 4A which schematically shows a partially assembled state of the offset pen.

Please refer to FIGS. 4A~4C. As shown in FIG. 4A, the holding portion 41 of the offset pen is integrally formed with a first part 421 of the intermediate portion 42, and the writing portion 43 is integrally formed with a second part 422 of the intermediate portion 42. For assembling the offset pen structure, the second part 422 is partially inserted into the first part 421 to be engaged with each other. The engagement of the two parts 421 and 422 is performed by tooth engagement, as shown in FIG. 4B. For mounting a writing material 40 which includes a writing tip 403 and an elongated ink refill 402 into the offset pen, the parts 421 and 422 of the intermediate portion 42 are disengaged. The writing material 40 is installed into the pen by inserting the writing tip 403 and the ink supply 402 into an hollow passage 44 inside the pen from the openings 4211 and 4221 of the parts 421 and 422 of the intermediate portion 42, respectively. A partially assembling state of the offset pen is shown in FIG. 4C.

Embodiment 2

Figure 5A:
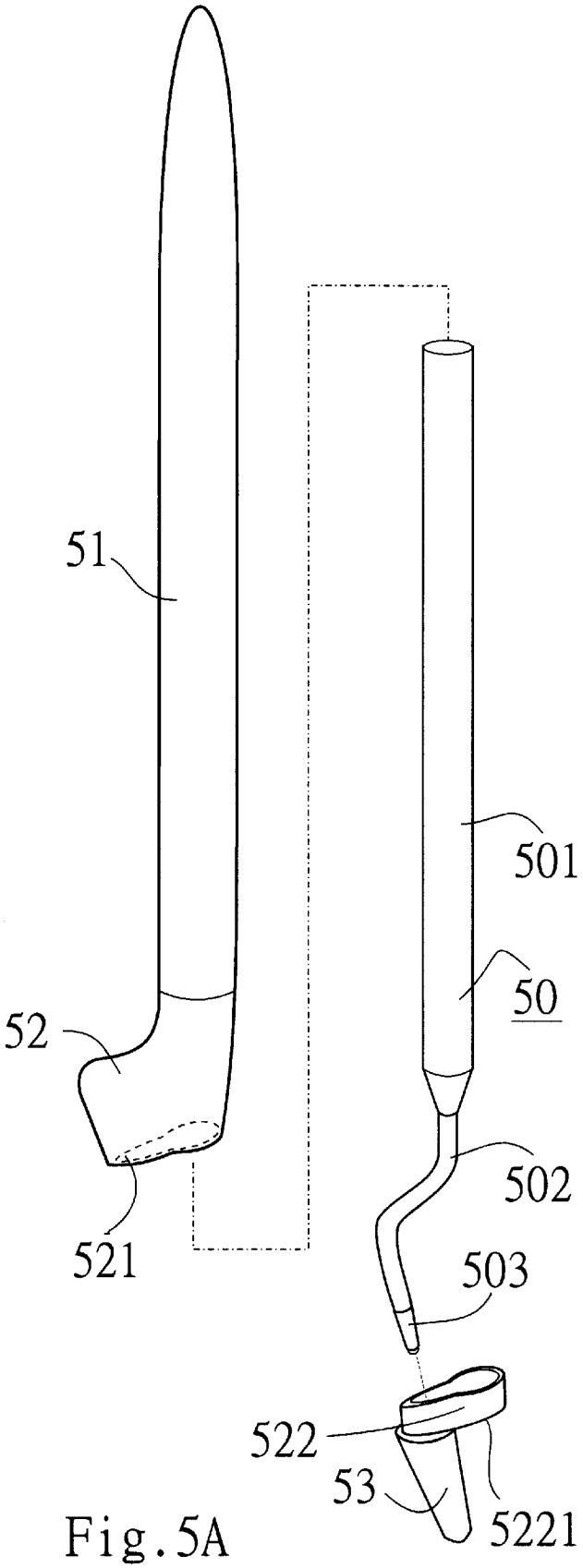
FIG. 5A is a resolving perspective diagram of a second preferred embodiment of an offset pen according to the present invention, which schematically shows the mounting of a writing material into the offset pen.
Figure 5B:
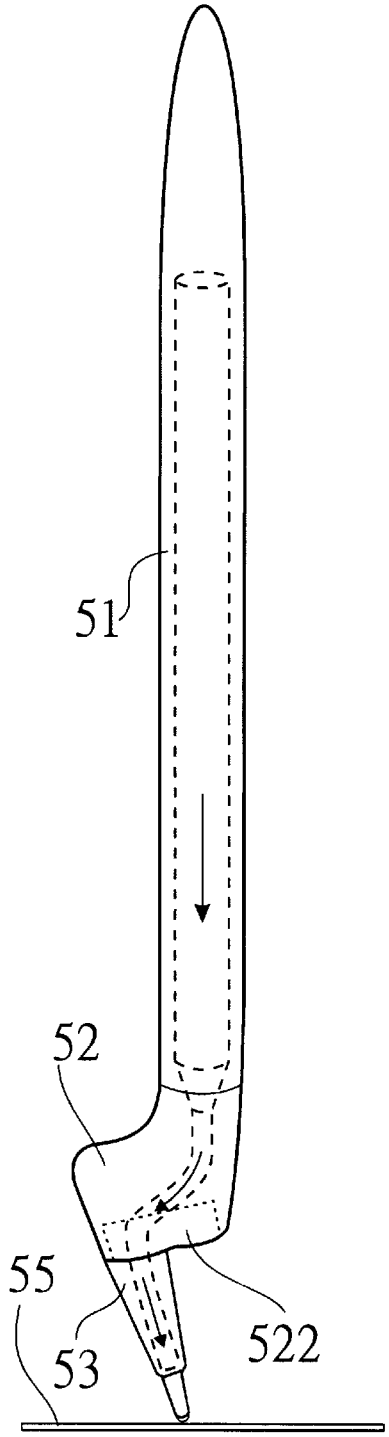
FIG. 5B is a side elevational view of the offset pen of FIG. 5A which schematically shows a partially assembled state of the offset pen.

Please refer to FIGS. 5A and 5B. The offset pen, as shown in FIG. 5A, is similar to the pen of embodiment 1 except that the holding portion 51 is further separable from the intermediate portion 52, and the second part 522 is completely inserted into the first part 521 with the lower surface 5221 thereof exposed to air only.

Figure 5C:
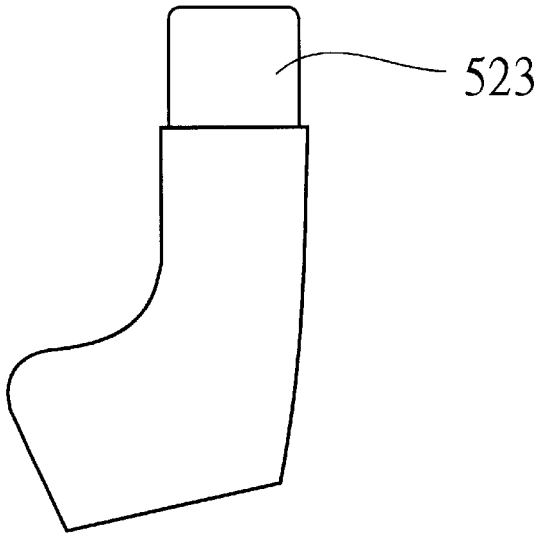
FIGS. 5C and 5D are two side elevational views schematically showing two alternatives of the intermediate portion of the offset pen of FIG. 5A, respectively, in order to illustrate two assembling ways between the holding portion and the intermediate portion of the offset pen.
Figure 5D:
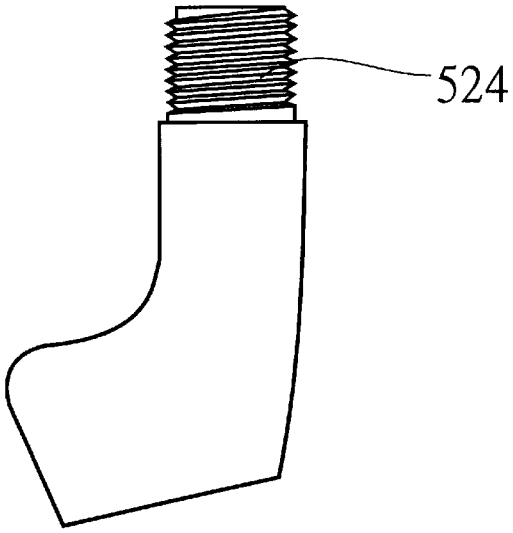

The writing material 50 used in this embodiment only for illustration includes an ink reservoir 501, an ink passage 502 and a writing tip 503. An assembling state of the offset pen is shown in FIG. 5B. Principally, the ink reservoir 501 is located in the holding portion 51, the ink passage 502 in the intermediate portion 52 and the writing tip 503 in the writing portion 53, respectively. For use, the ink stored in the ink reservoir 501 flows through the ink passage 502 to the writing tip 503 to leave marks on a working surface 55, as indicated by the arrows. The separation of the holding portion 51 from the intermediate portion 52 allows a relatively thick ink reservoir to be installed into the holding portion 51 in an alternative way, i.e. directly from the interface opening (not shown) between the holding portion 51 and the intermediate portion 52. As for the coupling of the holding portion and the intermediate portion, it can be achieved for example by sleeve engagement (see numeral reference 523, FIG. 5C) or screwing (see numeral reference 524, FIG. 5D).

Figure 5E:
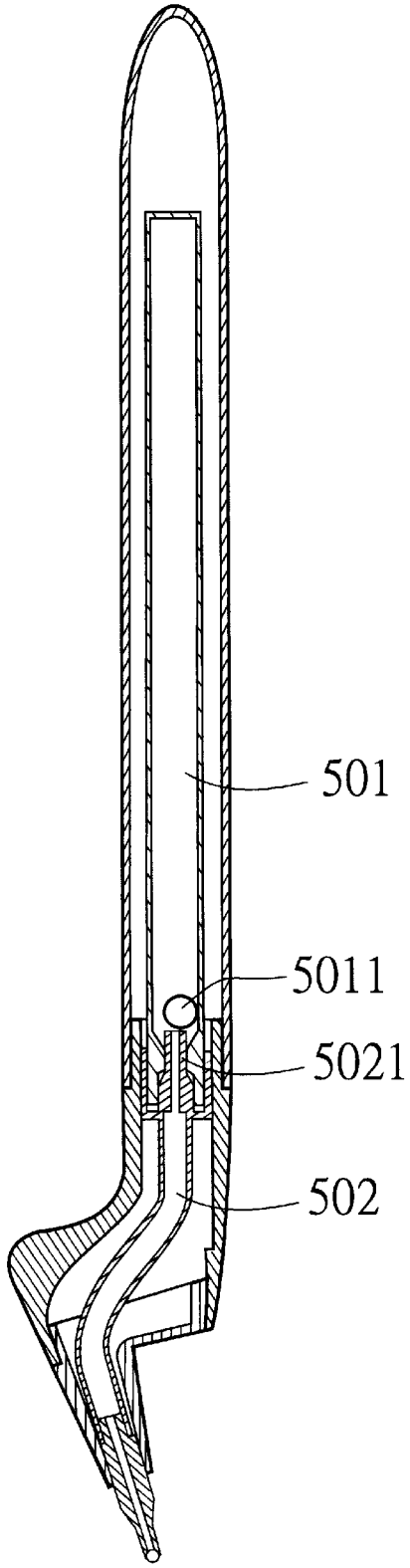
FIG. 5E is a cross-sectional view of the offset pen of FIG. 5A installed therein a writing material having a replaceable ink reservoir.

By the way, although the writing material shown in FIG. 5A is integrated, the ink reservoir and ink passage can alternatively be separate elements so that the ink reservoir is replaceable. For example, referring to FIG. 5E, there is a steel ball 5011 positioned at the bottom end of the ink reservoir 501, and there is a butting member 5021 at the top of the ink passage 502. For assembling the writing material, the butting member 5021 forces the steel ball 5011 away to receive ink from the ink reservoir 501. When the ink reservoir 501 becomes empty, it can be replaced with a new one easily, i.e. the holding portion 51 is disengaged from the intermediate portion 52, and then the new ink reservoir is inserted from the interface opening (not shown) between the holding portion 51 and the intermediate portion 52.

Embodiment 3

Figure 6:
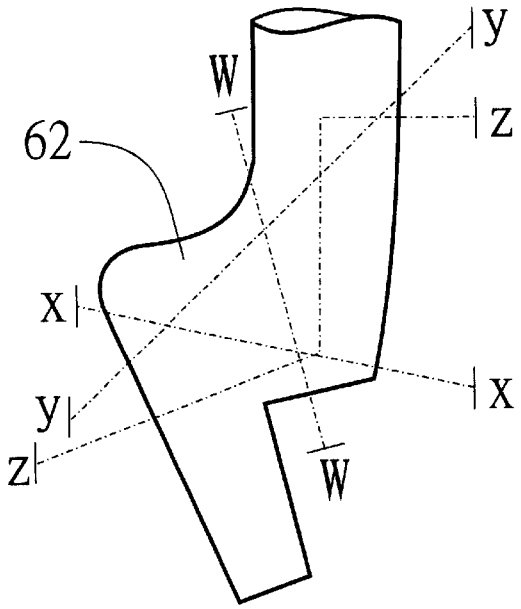
FIG. 6 is a partially side elevational view of a third embodiment of an offset pen according to the present invention, which schematically illustrates various dividing ways of the intermediate portion of the offset pen.

Please refer to FIG. 6. The offset pen is similar to the pen of embodiment 1 except that the division ways of the intermediate portion can be diverse. For example, the intermediate portion 62 can be divided along any one of the lines X—X, Y—Y, Z—Z and W—W, or any other way as long as it facilitates the production of the offset pen and the installation of the writing material.

Embodiment 4

Figure 7A:
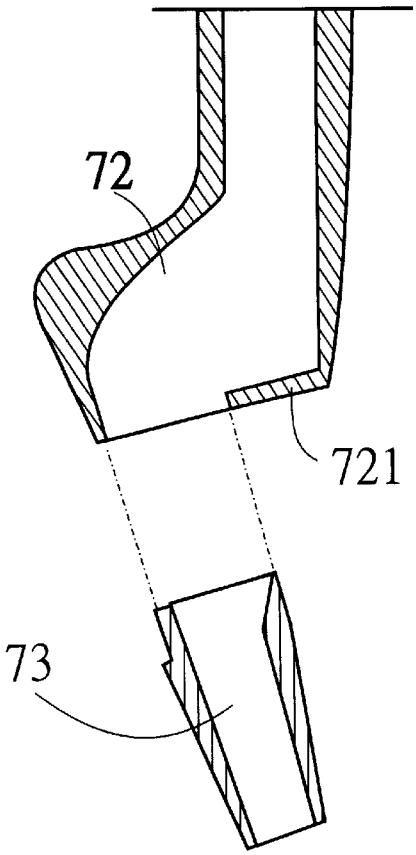
FIG. 7A is a partially cross-sectional view of a fourth embodiment of an offset pen according to the present invention, which schematically illustrates an alternative manner to separate the writing portion from the holding portion of an offset pen.

Please refer to FIG. 7A. The offset pen is similar to the pen of embodiment 1 except that the intermediate portion 72 is not divided, and in stead, the writing portion 73 is detachably mounted to the intermediate portion 72. By this way, the writing portion 73 can also be allowed to be separated from the holding portion (not shown) through the disengagement of the intermediate portion 72 and the writing portion 73.

Figure 7B:
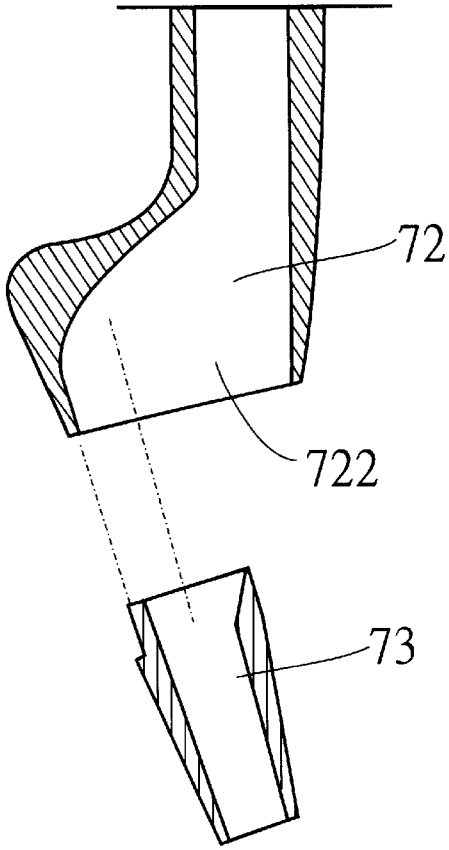
FIG. 7B is a partially cross-sectional view of the offset pen of FIG. 7A with a lower surface of the intermediate portion removed.

For certain cases, the lower surface 721 of the intermediate portion 72 shown in FIG. 7A can be removed to form an opening 722, as shown in FIG. 7B. The opening 722 allows any assistant device to be mounted in the lower part of the intermediate portion 72.

Embodiment 5

Figure 8A:
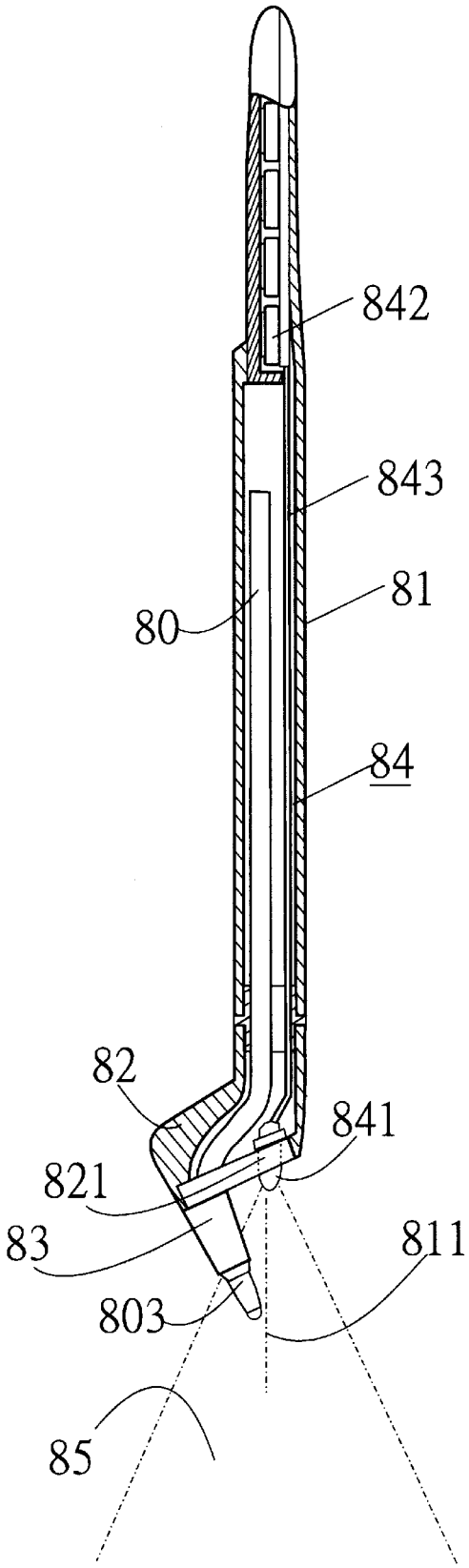
FIG. 8A is a partially cross-sectional view of a fifth embodiment of an offset pen according to the present invention, which schematically shows the inclusion of an illuminating device in the offset pen.
Figure 8B:
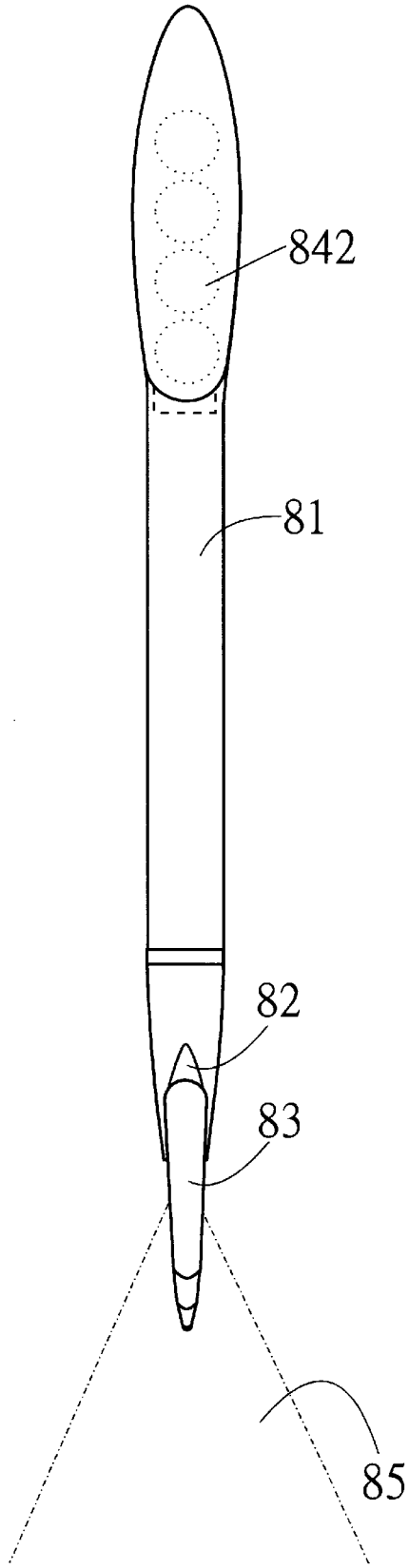
FIG. 8B is a front view of the offset pen of FIG. 8A.

Please refer to FIGS. 8A~8B. The offset pen is similar to the pen of embodiment 2 except that there is an illuminating device 84 mounted to the intermediate portion 82 for lightening an area 85 near the writing portion 83.

The illuminating device 84 includes a light bulb 841 and a battery set 842 which are interconnected via a wire 843. The light bulb 841 is a point light source having a size suitable for a pen and a light intensity suitable for writing. The light bulb 841 is installed in the lower part of the intermediate portion 82, and protrudes from the lower surface of the intermediate portion 82 through an opening 821. The battery set 842 is installed in the holding portion 81 for providing power for the light bulb 841. Although not shown, a switch for controlling the on/off state of the illuminating device 84 is preferably included. The light emitted from the illuminating device 84 reaches the area 85 near the writing portion 83 so as to let the user clearly see the working surface and avoid damaging the user's vision. If the writing tip 803 of a writing material 80 is substantially located in an extension line 811 of the holding portion 81, the light emitted from the illuminating device 84 can be centered on the writing tip 803 so as to enhance the lightening effect. By the way, it is understood that the additional separation of the holding portion 81 from the intermediate portion 82 facilitates the installation of the illuminating device 84.

Embodiment 6

Figure 9A:
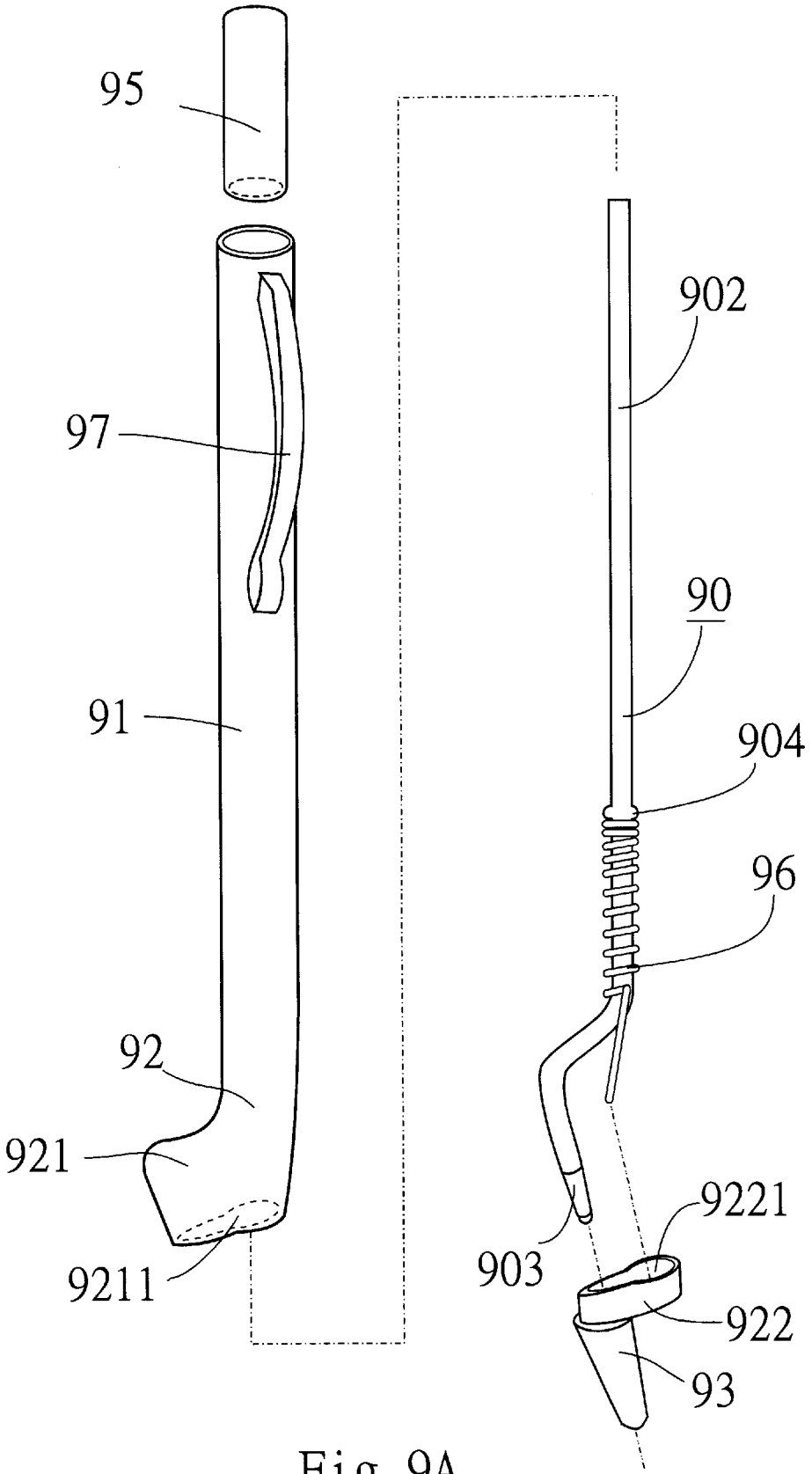
FIG. 9A is a resolving perspective diagram of a sixth preferred embodiment of an offset pen according to the present invention, which schematically shows the assembling of a retractable offset pen.
Figure 9B:
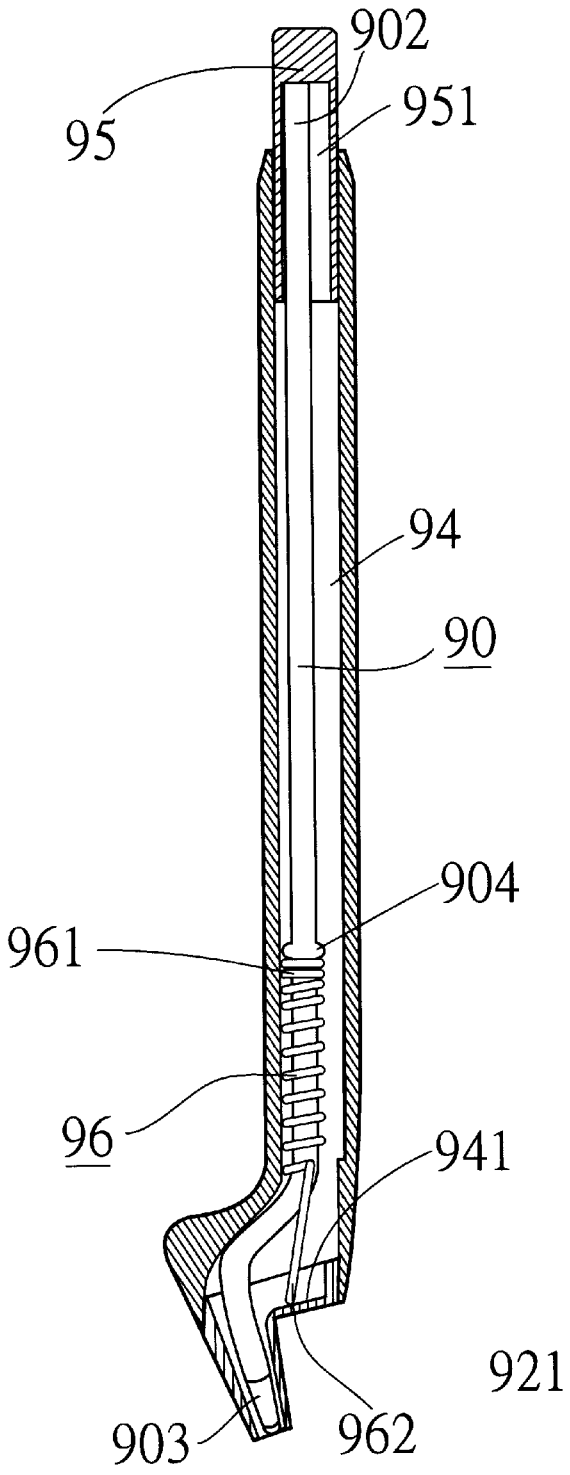
FIGS. 9B and 9C are two cross-sectional views schematically showing two operation modes of the offset pen of FIG. 9A, for deposit and for use, respectively.
Figure 9C:
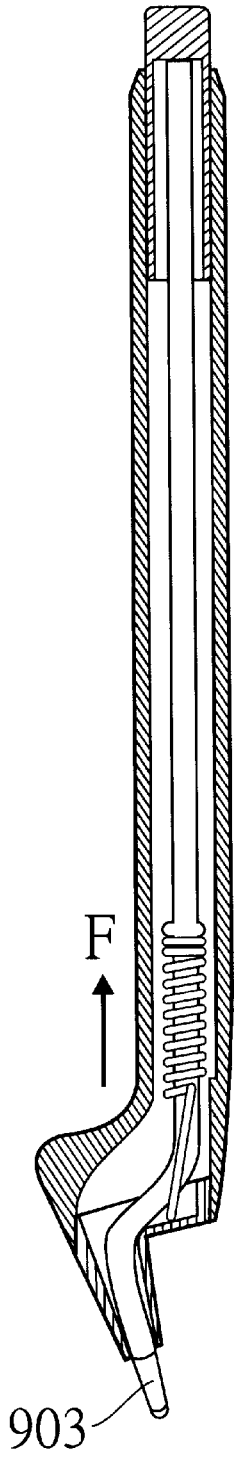

Please refer to FIGS. 9A~9C. In this embodiment, the holding portion 91 of the offset pen is integrally formed with a part 921 of the intermediate portion 92, the writing portion 93 is connected to another part 922 of the intermediate portion 92, and the two parts 921 and 922 are engaged to assemble the pen structure in a way as described in embodiment 2. For mounting a writing material 90 which includes a writing tip 903 and an elongated ink refill 902 into the offset pen, the parts 921 and 922 of the intermediate portion 92 are disengaged with each other. The writing material 90 is installed into the pen by inserting the writing tip 903 and the ink supply 902 into an hollow passage 94 (FIG. 9B) inside the pen from the openings 9211 and 9221 of the parts 921 and 922 of the intermediate portion 92, respectively.

Furthermore, the offset pen in this embodiment is a retractable pen which allows the writing tip 903 to selectively protrude from or to be retracted into the writing portion 93 in response to a user's operation. In order to achieve this purpose, the offset pen further includes a button 95 and a spring 96.

The button 95 is mounted on a top end of the holding portion 91, and has a hollow tube 951 (FIG. 9B) to be engaged with the ink supply 902 of the writing material 90. When the button 95 is pushed down to depress the writing material 90 from a relatively high position (FIG. 9B) to a relatively low position (FIG. 9C), the writing tip 903 can be made to protrude from the writing portion 93 to be used, as shown in FIG. 9C. On the other hand, when the button 95 is pushed down again to release the writing tip 903 from the relatively low position (FIG. 9C) to the relatively high position (FIG. 9B), the writing tip can be retracted into the writing portion 93 to be received, as shown in FIG. 9B.

Figure 9D:
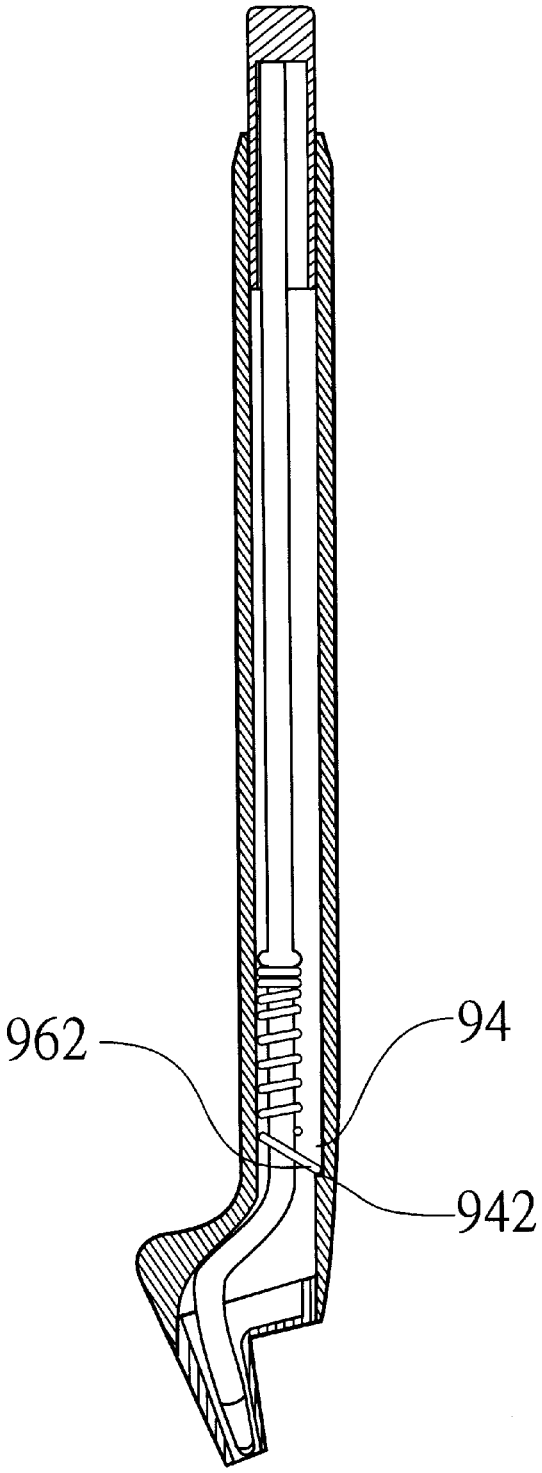
FIG. 9D is a cross-sectional view of the offset pen of FIG. 9A, which schematically shows an alternative of the writing material shown in FIG. 9B.

The spring 96 is installed around the writing material 90 in the hollow passage 94 within the pen. After the pen with the writing material 90 is assembled, the spring 96 has a first end 961 urging against a sustaining element 904 arranged on the writing material 90, and a resilient rod 962 sustaining against a facing-up wall 941 of the hollow passage 94 in the intermediate portion 92, as shown in FIGS. 9B and 9C. When the button 95 is pushed down, a compressive elastic force F (FIG. 9C) of the spring will be generated. When the button 95 is pushed again, the compressive elastic force will be provided for the release of the button 95 so as to retract the writing tip 903 into the writing portion 93. Alternatively, referring to FIG. 9D, the resilient rod 962 can sustain against a side wall 942 of the hollow passage 94 instead of the facing-up wall 941 to achieve the same purpose.

Moreover, the offset pen further includes a clip strip 97 (FIG. 9A) for clamping a holding piece such as pocket cloth, a piece of paper, or a plastic pen-holding sleeve of a notebook. It is to be noted that there should be efficient space within the hollow passage 94 in the intermediate portion 92 for the shift of the writing material 90 resulting from the push operation of the button 95, as compared FIG. 9B with FIG. 9C.

Embodiment 7

Figure 10A:
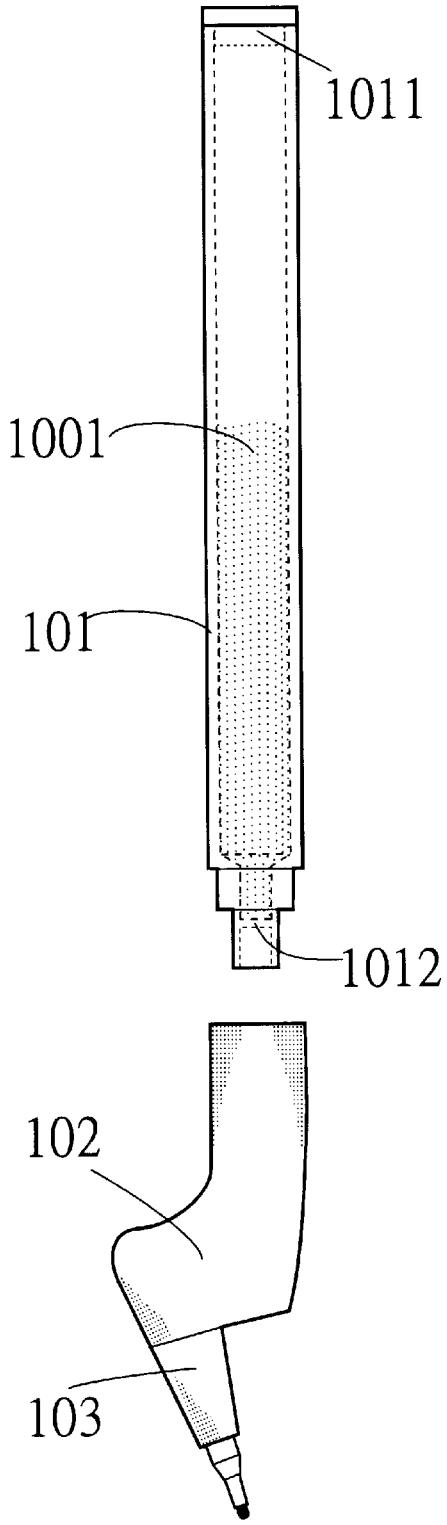
FIG. 10A is a partially resolving diagram of a seventh embodiment of an offset pen according to the present invention, which schematically shows the holding portion serving as an ink reservoir.
Figure 10B:
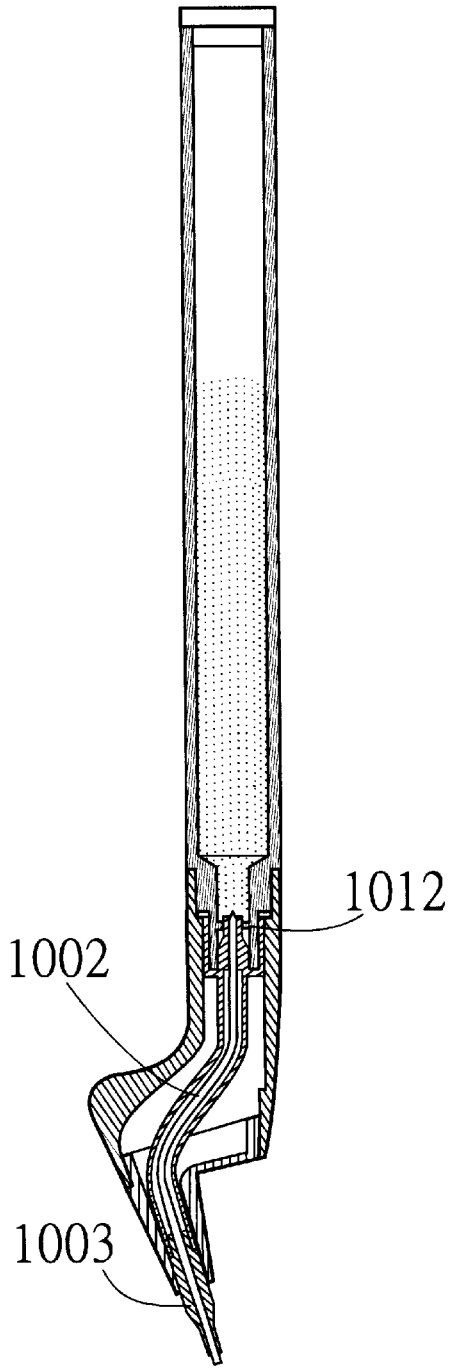
FIGS. 10B~10D are cross-sectional views of the offset pen of FIG. 10A with different writing tips.

Please refer to FIGS. 10A and 10B. The offset pen is similar to the pen of embodiment 2 except that the holding portion 101 itself serves as an ink reservoir 1001. Initially, ink is stored inside the holding portion 101, and two ends of the holding portion 101 are stopped from ink leakage by a lid 1011 and a stopper 1012, respectively. For an assembling operation, one end of the ink passage 1002 pierces through the stopper 1012 to introduce therein the ink stored in the ink reservoir 1001. In other words, ink can flow down to the writing tip 1003 through the ink passage 1002. If the ink stored in the ink reservoir 1001 is insufficient, it can be supplied from the top end of the holding portion 101 by taking off the lid 1011.

Figure 10C:
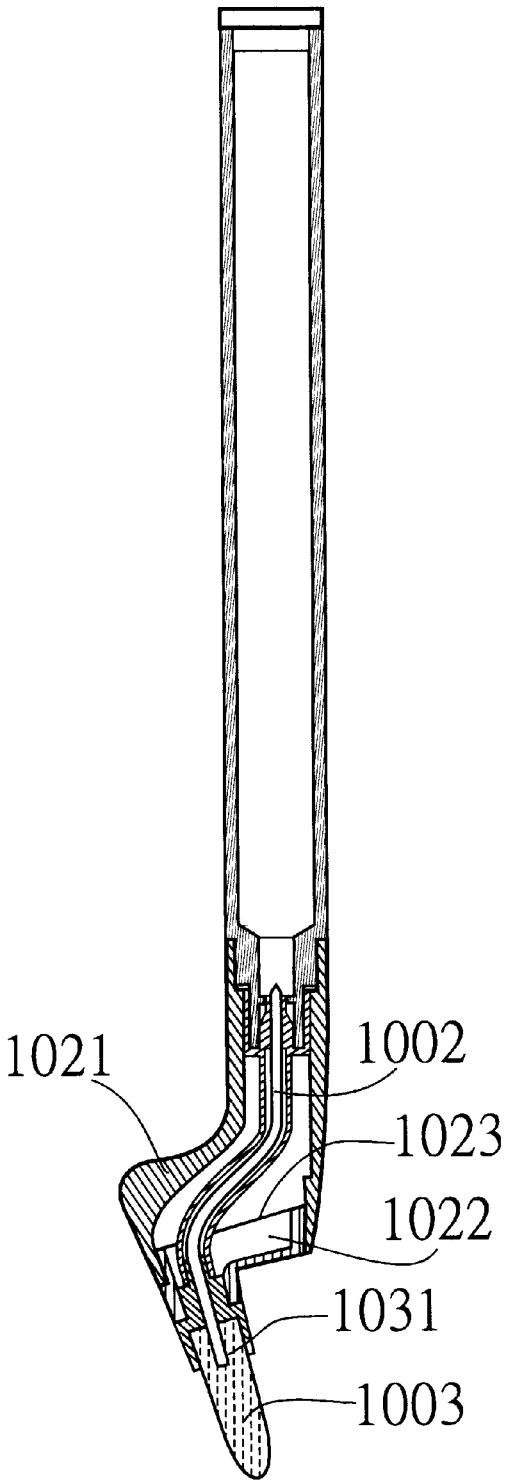
Figure 10D:
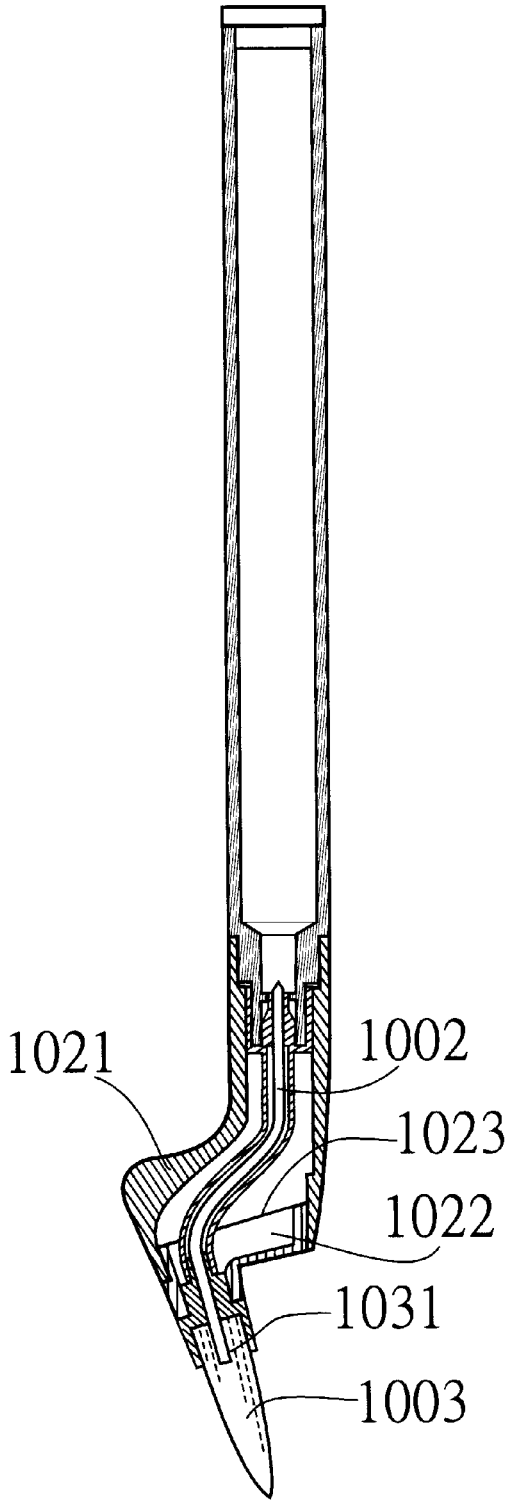

By the way, the writing tip 1003 of the writing material used in this embodiment is a felt tip, and the ink passage 1002 is an ink-soaking strip which adsorbs ink therein. Alternatively, it can be a hollow tube which stores ink therein, depending on the type of the writing tip. The writing tip can also be a fiber tip, a soft rubber tip or a brush tip, and the size and shapes of the writing tip can also be various, depending on the use of the pen. It is to be mentioned that the installation ways of the writing material will also be varied with the shapes of the writing tip. For example, as shown in FIGS. 10C and 10D, the relatively bulky writing tip 1003 should be separable from the ink passage 1002 so that it can be installed from the lower opening 1031 of the writing portion 103 rather than from the interface opening 1023 between the first and the second parts 1021 and 1022 of the intermediate portion 102. On the other hand, for a writing tip of a fiber, a soft rubber or a brush type having a shape as shown in FIG. 10C or 10D, the ink passage 1002 is preferably an ink-soaking material in order to provide ink smoothly.

Embodiment 8

Figure 11:
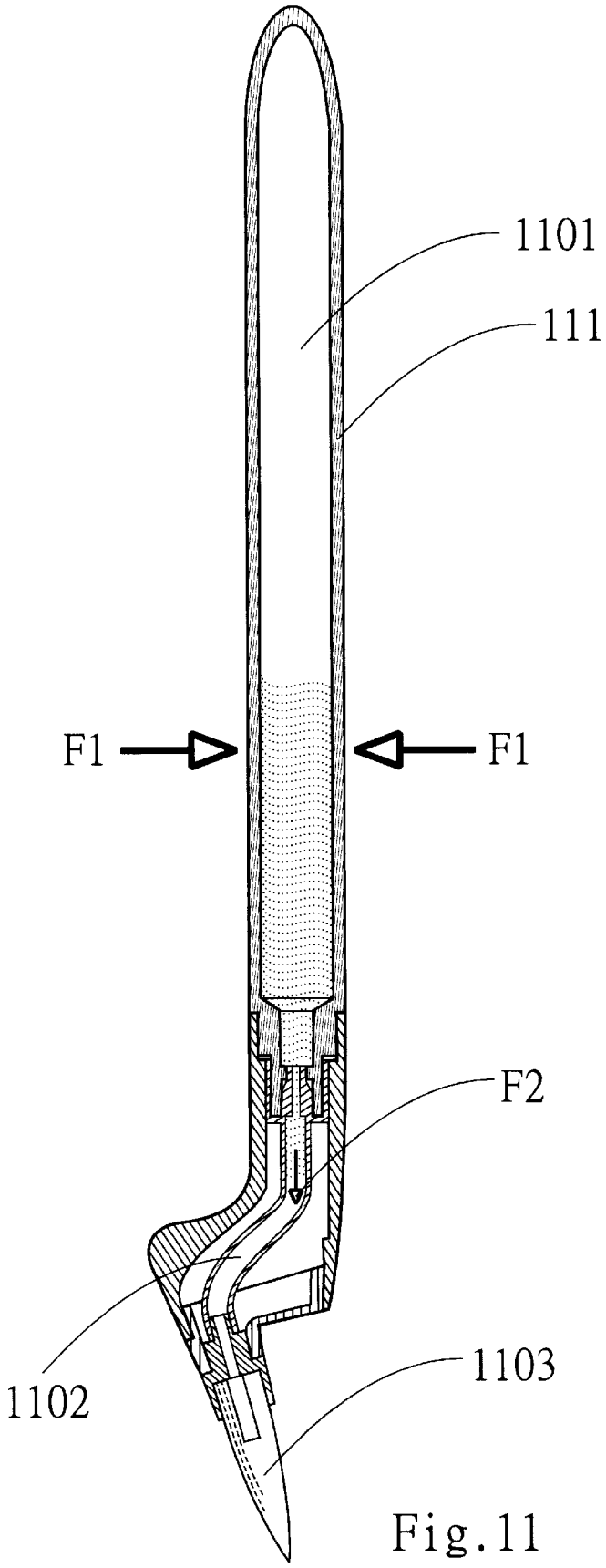
FIG. 11 is a cross-sectional view of an eighth embodiment of an offset pen according to the present invention, which schematically shows a flexible holding portion of the offset pen.

Please refer to FIG. 11. The offset pen is similar to the pen of embodiment 7 except that the holding portion 111 serving as the ink reservoir 1101 is flexible. By exerting a pressing force (arrows F1) with fingers onto the holding portion 111, ink can be forced to flow to the writing tip 1103 through the ink passage 1102 (arrow F2).

By the way, the writing tip 1103 of a writing material used in this embodiment is a brush tip, and the ink passage 1102 is a hollow tube.

Embodiment 9

Figure 12A:
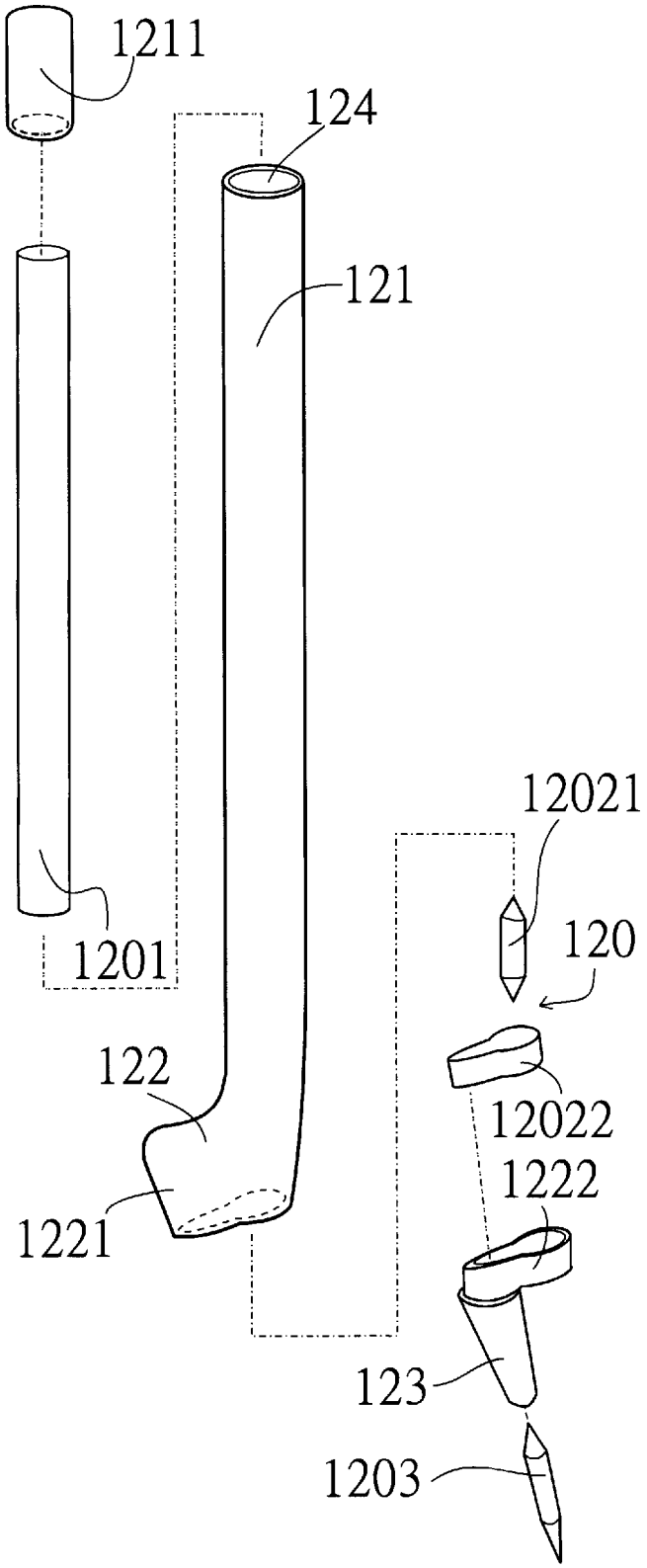
FIG. 12A is a resolving perspective diagram of a ninth preferred embodiment of an offset pen according to the present invention, which schematically shows the installation of a writing material consisting of separate parts into the offset pen.
Figure 12B:
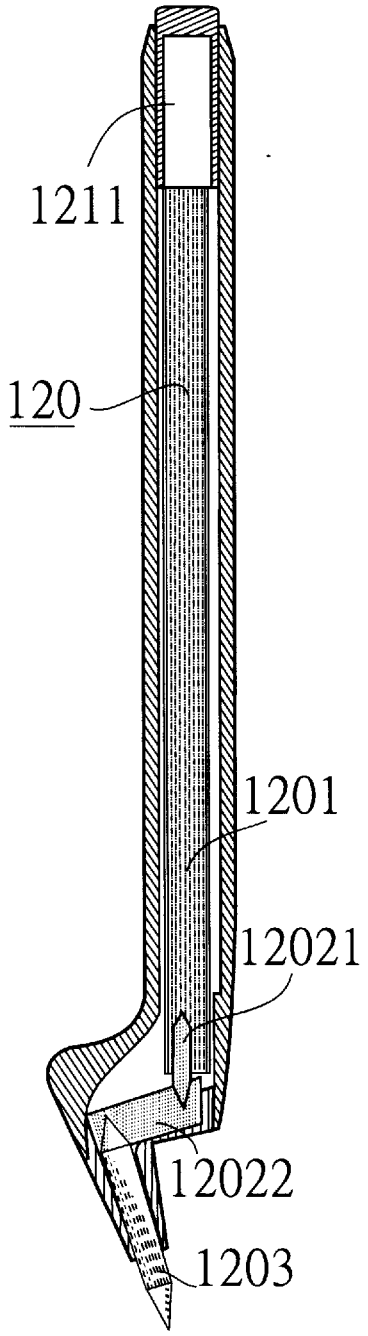
FIG. 12B is a cross-sectional view of the assembled offset pen of FIG. 12A.
Figure 13A:
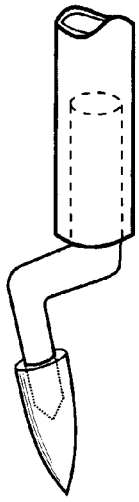
FIGS. 13A~13D schematically show four types of writing materials and the assembling manners thereof, respectively.
Figure 13B:
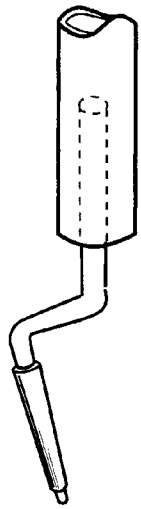
Figure 13C:
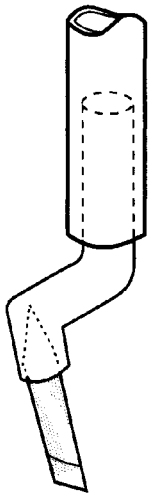
Figure 13D:
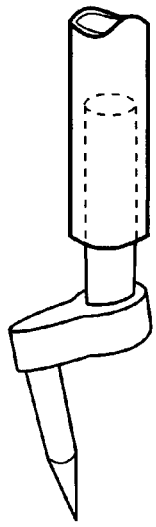

Please refer to FIGS. 12A and 12B. The offset pen is similar to the pen of embodiment 2 except that the holding portion 121 is integrally formed with the first part 1221 of the intermediate portion 122, and an end portion of the holding portion 121 has a cover 1211 which can be opened to expose the hollow passage 124 to air. Such arrangement of the offset pen is advantageous for mounting a writing material 120 consisting of several separate parts.

The writing material 120 used in this embodiment as shown includes an ink reservoir 1201, ink passages 12021 and 12022, and a writing tip 1203 having respective shapes shown in FIG. 12A, and made of ink-soaking material. The installation of the writing material 120 is illustrated as follows with reference to FIG. 12A, and the assembled writing material is shown in FIG. 12B. The ink passages 12021 and 12022 are coupled and placed into the second part 1222 of the intermediate portion 122. The writing tip 1203 is inserted into the writing portion 123 from the lower opening of the writing portion, and attached to the ink passage 12022. The ink reservoir 1201 is placed into the hollow passage 124 from the top of the holding portion 121 by temporarily removing the cover 1211. When the cover 1211 is inserted back into the holding portion 121, it will press the ink reservoir 1201 to be pieced thereinto the sharp tip of the ink passage 12022. Accordingly, the writing material has been assembled and installed into the pen, thereby allowing ink to continuously flow through the writing material for writing.

By the way, the shapes, sizes and materials of the ink reservoir, the ink passage and the writing tip can be various as long as they are easily combined and installed into the pen. Examples are given as shown in FIGS. 13A~13D.

Figure 14A:
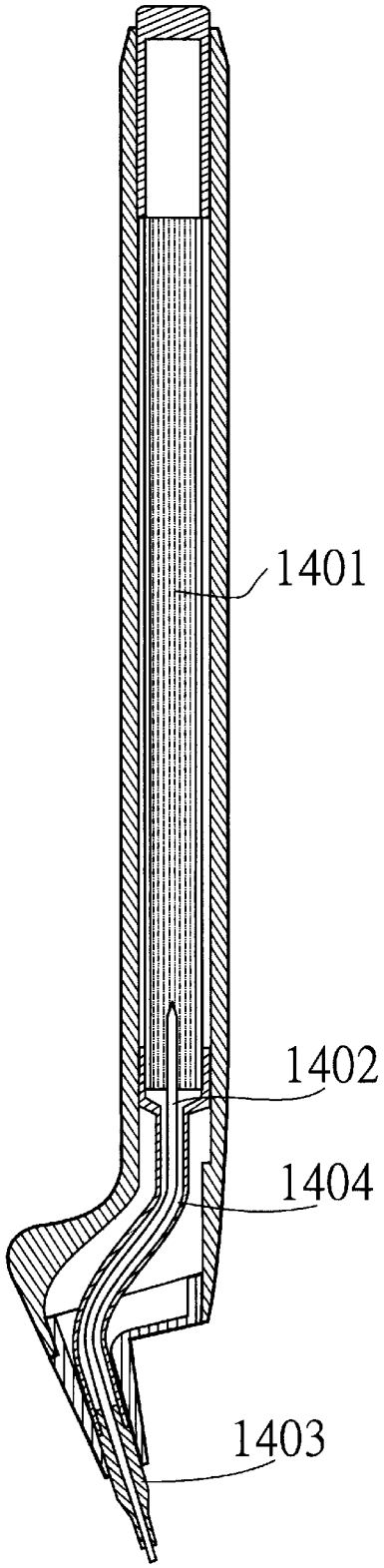
FIGS. 14A and 14B are cross-sectional views of the offset pen of FIG. 12A with different kinds of writing materials.
Figure 14B:
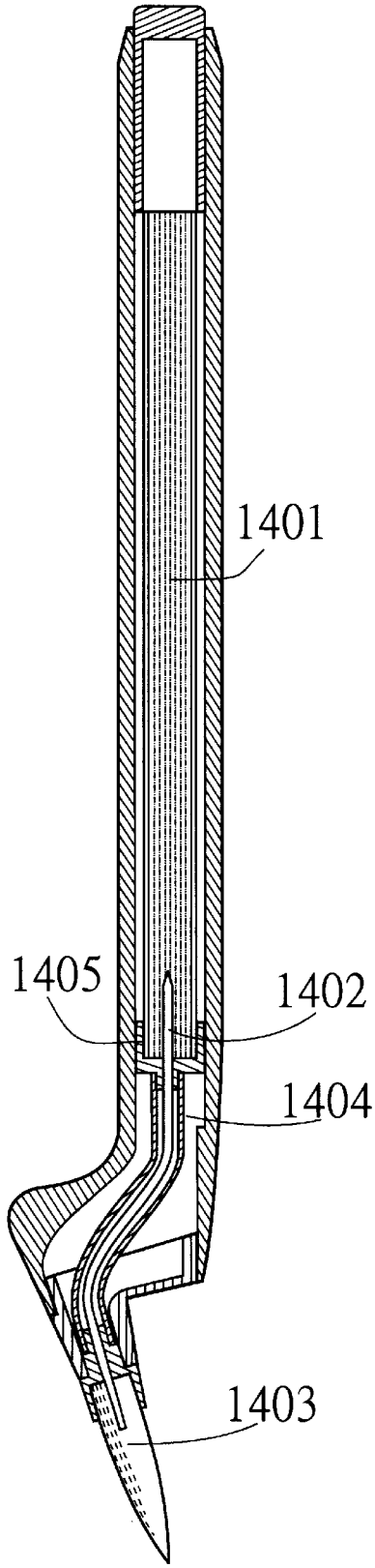

FIGS. 14A and 14B show other types of writing materials used with the offset pen structure of this embodiment. As shown, the ink passage 1402 is an ink-soaking strip and wrapped with an ink-proofing material 1404 to prevent from ink leakage. The ink-proofing material can be a film, a plastic tube or any other type of protecting member as long as the same purpose can be achieved. In addition to the difference in writing tips 1403, another difference between the writing materials of FIGS. 14A and 14B lies in that the ink-proofing tube 1404 enclosing the ink passage 1402 continuously extends to wrap a part of the ink reservoir 1401 in FIG. 14A, but is independent of the ink-proofing tube 1405 wrapping a part of the ink reservoir 1401 in FIG. 14B. The separation of the ink-proofing tubes has an effect on the installation of the writing material having a relatively large writing tip into the offset pen of this embodiment.

Various embodiments of offset pens according to the present invention are described as above, but the embodiments are given only for illustration rather than limitation of the scope of the present invention. For example, the holding portion, intermediate portion and/or the writing portion of an offset pen according to the present invention can be further divided into parts if it is convenient for the manufacturing of the pen and/or the mounting of a writing material into the pen. It should be understood that under the same offset pen structure, a variety of writing materials may be suitable for cooperating therewith to form a specific pen. On the other hand, the selection or design of a writing material should comply with the structure of the offset pen in order to facilitate installation. For example, the ink reservoir, the ink passage and the writing material are optionally separable depending on the sizes and shapes thereof and the design of the offset pen structure. An ink-proofing material is used to wrap the writing material if necessary, especially when the writing material is made of ink-soaking material, in order to prevent ink from leakage.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An offset pen structure to be mounted therein a crooked writing material to leave marks on a working surface, comprising:

a holding portion to be supported by a user's writing hand;

a writing portion to be mounted therein a writing tip of said writing material; and an intermediate portion connected to both said holding portion and said writing portion to deflect said writing portion from an axis of said holding portion;

wherein said intermediate portion consists of two engageable parts, a first part of which is connected to said holding portion to form a first bent corner, and a second part of which is connected to said writing portion to form a second bent corner, and an opening allowing a crook of said writing material to be inserted therefrom into said intermediate portion, said opening being exposed by taking said first and said second parts apart in order to facilitate the mounting of said crooked writing material.

2. The offset pen structure according to claim 1 wherein said second part is partly inserted into said first part to form said intermediate portion.

3. The offset pen structure according to claim 1 wherein said second part of said intermediate portion is completely inserted into said first part to form said intermediate portion.

4. The offset pen structure according to claim 1 arranged therewithin a hollow passage which extends from said writing portion through said intermediate portion to said holding portion for accommodating said writing material including said writing tip and an ink supply, and said hollow passage extends through said opening in said intermediate portion.

5. The offset pen structure according to claim 4 being a retractable pen which allows said writing tip to selectively protrude from or to be retracted into said writing portion in response to a user's operation.

6. The offset pen structure according to claim 5 further comprising:

a button mounted on a top end of said holding portion, and having a hollow tube to be engaged with said ink supply, wherein said button can be pushed down to be depressed from a relatively high position to a relatively low position to make said writing tip protrude from said writing portion, and can be pushed down again to be released from said relatively low position to said relatively high position to make said writing tip retracted into said writing portion; and a spring installed in said hollow passage around said writing material, and having a first end urging against a sustaining element arranged on said writing material and a second end urging against a wall of said hollow passage to generate a compressive elastic force provided for the release of said button so as to retract said writing tip into said writing portion.

7. The offset pen structure according to claim 6 wherein said second end of said spring is a resilient rod sustaining against a facing-up wall of said hollow passage in said intermediate portion.

8. The offset pen structure according to claim 4 wherein said holding portion can be detached from said intermediate portion to expose said hollow passage to air so that said ink supply can be installed therefrom.

9. The offset pen structure according to claim 4 wherein an end portion of said holding portion can be opened to expose said hollow passage to air so that said ink supply can be installed therefrom.

10. The offset pen structure according to claim 4 wherein said holding portion serves as said ink supply.

11. The offset pen structure according to claim 10 wherein said holding portion is flexible so that ink can be transmitted to said writing tip by pressing said holding portion.

12. The offset pen structure according to claim 4 wherein said ink supply is an elongated ink refill extending from said writing portion through said intermediate portion to said holding portion.

13. The offset pen structure according to claim 4 wherein said ink supply includes an ink reservoir installed in said hollow passage in said holding portion for providing therefrom ink; and an ink passage connected to said ink reservoir and said writing tip for transmitting ink from said ink reservoir to said writing tip, and having a shape and a size complying with a configuration of said hollow passage in said intermediate portion so as to extend through said intermediate portion.

14. The offset pen structure according to claim 13 wherein said ink reservoir is separable from said ink passage so as to allow said ink reservoir to be replaced.

15. The offset pen structure according to claim 13 wherein said ink reservoir is a hollow tube for storing therein ink.

16. The offset pen structure according to claim 15 wherein said ink passage is an hollow tube.

17. The offset pen structure according to claim 15 wherein said ink passage is an ink-soaking strip.

18. The offset pen structure according to claim 13 wherein said ink reservoir and said ink passage are both ink-soaking strips for adsorbing therein ink.

19. The offset pen structure according to claim 13 wherein said ink supply is wrapped with an ink-proofing material to prevent ink from leakage.

20. The offset pen structure according to claim 1 wherein said writing tip is selected from a group consisting of a felt tip, a nib tip and a brush tip.

21. The offset pen structure according to claim 1 further including an illuminating device mounted to said second part of said intermediate portion to lighten an area near said writing tip.

22. The offset pen structure according to claim 21 wherein said writing tip is substantially located in an extension line of said holding portion so that light emitted from said illuminating device can be centered on said writing tip.

23. The offset pen structure according to claim 21 wherein said illuminating device is a point light source.

24. The offset pen structure according to claim 23 wherein said illuminating device is a light bulb.

25. The offset pen structure according to claim 21 wherein a battery for supplying power for said illuminating device is installed in said holding portion.

26. An offset pen structure to be mounted therein a crooked writing material to leave marks on a working surface, comprising:

a holding portion to be supported by a user's writing hand;

a writing portion to be mounted therein a writing tip of said writing material; and an intermediate portion has a first end connected to said holding portion and a second end detachably connected to said writing portion to deflect said writing portion from an axis of said holding portion;

wherein said intermediate portion has an opening at said second end, which is partly covered with said writing portion when said writing portion is connected to said intermediate portion, and completely exposed to allow a crook of said writing material to be inserted therefrom when said writing portion is detached from said intermediate portion.

27. An offset pen structure to be mounted therein a writing material to leave marks on a working surface, comprising:

a holding portion to be supported by a user's writing hand;

a writing portion to be mounted therein a writing tip of said writing material; and an intermediate portion connected to both said holding portion and said writing portion to deflect said writing portion from an axis of said holding portion, and consisting of two engageable parts, a first part of which is connected to said holding portion and a second part of which is connected to said writing portion, so that said writing portion is separable from said holding portion by taking said first and said second parts apart in order to facilitate the mounting of said writing material;

wherein a hollow passage extends from said writing portion through said intermediate portion to said holding portion for accommodating said writing material including said writing tip and an ink supply; and wherein said offset pen is a retractable pen which allows said writing tip to selectively protrude from or to be retracted into said writing portion in response to a user's operation, and includes:

a button mounted on a top end of said holding portion, and having a hollow tube to be engaged with said ink supply, wherein said button can be pushed down to be depressed from a relatively high position to a relatively low position to make said writing tip protrude from said writing portion, and can be pushed down again to be released from said relatively low position to said relatively high position to make said writing tip retracted into said writing portion; and a spring installed in said hollow passage around said writing material, and having a first end urging against a sustaining element arranged on said writing material and a second end urging against a wall of said hollow passage to generate a compressive elastic force provided for the release of said button so as to retract said writing tip into said writing portion.

* * * * *